US006184450B1

(12) United States Patent
LeBlanc

(10) Patent No.: US 6,184,450 B1
(45) Date of Patent: Feb. 6, 2001

(54) UNIVERSAL, MULTI-POSITION, TUNING MECHANISM AND BRIDGE FOR STRINGED MUSICAL INSTRUMENTS

(76) Inventor: Curtis Robert LeBlanc, 153 Chisholm Trail, Thibodaux, LA (US) 70301

( * ) Notice: Under 35 U.S.C. 154(b), the term of this patent shall be extended for 0 days.

(21) Appl. No.: 09/146,129

(22) Filed: Sep. 2, 1998

(51) Int. Cl.[7] ..... G10D 3/04; G10D 3/14
(52) U.S. Cl. ..... 84/307; 84/298; 84/312 R
(58) Field of Search ..... 84/297 R–312 P

(56) References Cited

U.S. PATENT DOCUMENTS

| | | | | |
|---|---|---|---|---|
| 2,624,027 | | 12/1952 | Clark | 318/29 |
| 3,479,917 | | 11/1969 | Zitnik, Jr. et al. | 84/312 |
| 3,599,524 | | 8/1971 | Jones | 84/312 |
| 4,457,201 | * | 7/1984 | Storey | 84/312 R |
| 4,625,613 | | 12/1986 | Steinberger | 84/298 |
| 4,688,461 | | 8/1987 | Stroh | 84/298 |
| 4,867,031 | | 9/1989 | Fender | 84/313 |
| 4,928,563 | | 5/1990 | Murata et al. | 84/726 |
| 5,095,797 | | 3/1992 | Zacaroli | 84/455 |
| 5,265,512 | | 11/1993 | Kubicki et al. | 84/298 |
| 5,438,902 | | 8/1995 | Baker | 84/312 R |
| 5,539,143 | | 7/1996 | Rose | 84/298 |
| 5,542,330 | | 8/1996 | Borisoff | 84/298 |
| 5,602,353 | | 2/1997 | Juszkiewicz et al. | 84/298 |

* cited by examiner

*Primary Examiner*—Stanley J. Witkowski
(74) *Attorney, Agent, or Firm*—John D. Gugliotta

(57) ABSTRACT

An improved, universal, multi-position, tuning mechanism and bridge for stringed musical instruments, designed to provide quick, easy adjustment of the tension of the each string of musical instruments between one of two predetermined tension levels, as well as precise adjustment mechanisms for the traditional tension settings of each string, with all components being safely housed in an easily accessible main body. The present invention includes a support plate mounted to the front surface of the body of a musical instrument. A main body and roller-type bridge are mounted to the top of the support plate. Inside the main body, a plurality of levers, spring loaded plungers and tension adjustment screws are individually adjustable to vary the tension in each string. A multi-tuning lever arm adjusts the tension of the each string between one of two predetermined tension levels. A lever arm adjustment means allows quick and precise adjustment of the tension in each of these two pre-determined settings. It is envisioned that in an alternate embodiment of the present invention, the main body is mounted just behind the head of the guitar, and is used in conjunction with a roller type nut, positioned on the guitar neck, just behind the main body.

13 Claims, 11 Drawing Sheets

UNIVERSAL, MULTI-POSITION, TUNING MECHANISM AND BRIDGE FOR STRINGED MUSICAL INSTRUMENTS

BACKGROUND OF THE INVENTION

1. Field of the Invention

The present invention relates generally to tuning devices for musical instruments, and, more particularly, to an improved, universal, multi-position, tuning mechanism and bridge for stringed musical instruments.

2. Description of the Related Art

As is well known, guitars are a popular form of musical expression in the United States and worldwide. The majority of guitars utilize a single tuning configuration, allowing only one setting of tuned strings per instrument. This tuning must be provided for each string before a song can be played in tune via string manipulation.

Many artists who perform with stringed instruments, such as guitars, wish to be able to change tuning occasionally. This is desired to change the sound that the strings make, and, consequently, the sound that the instrument can create. Artistic expression of the artist is, therefore, limited, if the musician cannot change the tuning configuration of the strings of a guitar quickly and efficiently.

Changing the tension of guitar strings manually can be a time-consuming process. It takes time to tune all the strings to be "on note" or "on key." Performing this task between songs, as during a concert performance, is difficult if not impossible to accomplish. Changing the tuning of a guitar during a song with traditional tuning means is all but impossible, especially given the sophistication of today's live audiences, who can sense an out of tune string on a guitar.

Devices in the previous art, therefore, were designed to replace the traditional stop piece on guitars that incorporate separate stop piece/bridge configurations and permit the quick and accurate adjustment of string tension of a stringed instrument, thus providing the musician with more flexibility to facilitate artistic expression and creativity.

U.S. Pat. No. 5,438,902, issued in the name of Baker, discloses a multi-tuner for stringed musical instruments wherein an adjustable cam mechanism allows the user to select different predefined string tensions for all of the strings by rotating the cam.

U.S. Pat. No. 3,479,917, issued in the name of Zitnik, Jr. et al., discloses a multiple lever tone changer for guitars wherein individual levers are provided to allow the musician to create a vibrato effect, either on single strings or on the entire set of strings.

Two patents disclose bridge assemblies for guitars that incorporate adjustable intonation means: U.S. Pat. No. 4,867,031, issued in the name of Fender and U.S. Pat. No. 5,602,353, issued in the name of Juszkiewicz et al.

U.S. Pat. No. 3,599,524, issued in the name of Jones, discloses an adjustable bridge assembly for guitars wherein individual string saddles replace the nut and bridge, allowing for intonation adjustment from both ends of the string.

Several patents disclose bridge assemblies for guitars that incorporate adjustment means for changing individual string tension, intonation and saddle height: U.S. Pat. No. 4,625,613, issued in the name of Steinberger, U.S. Pat. No. 4,688,461, issued in the name of Stroh, U.S. Pat. No. 5,265,512, issued in the name of Kubicki et al., and U.S. Pat. No. 5,539,143, issued in the name of Rose.

Several patents disclose automatic string tension adjusting means for stringed instruments that maintains a predefined tone for each string by electronically monitoring the string tone and adjusting it via an electric motor. These include U.S. Pat. No. 2,624,027, issued in the name of Clark, U.S. Pat. No. 4,928,563, issued in the name of Murata et al., and U.S. Pat. No. 5,095,797, issued in the name of Zacaroli. Such devices, however, are expensive and complicated, and as such are prone to electronic component failure with repeated use.

A search of the prior art did not disclose any patents that read directly on the claims of the instant invention.

Of considerable relevance is U.S. Pat. No. 5,542,330, issued in the name of Borisoff. The '330 patent discloses a multi-tuner for stringed musical instruments wherein an adjustable lever mechanism allows the user to select, on a per string basis, from three different predefined string tensions.

There are several problems with the '330 device, however. First, the '330 device is designed to use the mounting mechanism on Fender™ guitars. Since the '330 device is designed to function only with a Fender™ type guitar configuration, it is not designed to be used with the vast majority of stringed instruments. Second, the '330 configuration is complex. Third, the '330 device connects to the guitar face behind the bridge, therefore, taking up additional space on the face of the guitar face and, consequently, limiting the location where the device can be positioned on the guitar. This limitation on placement location further limits the '330's applicability to non-Fender™ type guitars.

While the general concept of the per string, multi-position tuning feature is incorporated into this invention in combination, other elements are different enough as to make the combination distinguished over the inventors' own prior art. Consequently, a need has therefore been felt for an improved but less complex mechanism that provides per string multi-position tuning capabilities for stringed musical instruments.

SUMMARY OF THE INVENTION

It is therefore an object of the present invention to provide an improved, universal, multi-position, tuning mechanism and bridge for stringed musical instruments of simplified design, that can be used with all existing guitar configurations, including Fender™ guitars, is easy to install, provides improved multi-position tuning capabilities, provides the musician with two preset tuning positions per string, is capable of permitting variations in intonation, permitting instantaneous adjustments in string tuning between and during songs, without altering the acoustic characteristics of the soundboard to prevent structural damage to the instrument, and is comfortable to the musician while playing the musical instrument.

Briefly described according to one embodiment of the present invention, an improved, universal, multi-position, tuning mechanism and bridge for stringed musical instruments is disclosed, designed to provide quick, easy adjustment of the tension of each string of musical instruments between one of two predetermined tension levels, as well as precise adjustment mechanisms for the traditional tension settings of each string, with all components being safely housed in an easily accessible main body.

The present invention comprises a support plate mounted to the front surface of the body of a musical instrument. A main body and roller-type bridge are mounted to the top of the support plate. Inside the main body, a plurality of levers, spring loaded plungers and tension adjustment screws are individually adjustable to change the tension of each of a particular string. A multi-tuning lever arm adjusts the tension of each string between one of two predetermined tension levels. A lever arm adjustment means allows quick and precise adjustment of the tension in each of these two predetermined settings.

It is envisioned that in an alternate embodiment of the present invention, the main body is mounted just behind the head of the guitar, and is used in conjunction with a roller type nut, positioned on the guitar neck, just behind the main body.

It is another object of the present invention to provide a device that functions with not only a Fender™ type guitar configuration, but also with the vast majority of stringed instruments.

It is another object of the present invention to provide a device onto which a bridge of a guitar can be mounted. This configuration provides several benefits. First, there are fewer pieces to buy. Second, the configuration is sturdier. Third, the present invention is easy to install. Fourth, more streamline aesthetic appearance is created. Fifth, the configuration permits the present invention to be mounted in a plurality of position along the elongated centerline of the face of the guitar, further widening its applicability to all guitars, both Fender™ and non-Fender™ configurations. Sixth, the dual configuration is more comfortable for the music player than a separate bridge/multi-tuner configuration.

It is another object of the present invention to provide a device that is simple in design.

It is another object of the present invention to provide a device that provides a multi-tuner string configuration that provides a consistent, stable, secure tuning position for the guitar strings at each preset tuning setting. As such, each tuning position will maintain each guitar string "on key" over the course of a performance, thus eliminating constant presetting of the string tuning control position on the device.

| DESCRIPTIVE KEY | |
|---|---|
| 20 | improved, universal, multi-position, tuning mechanism and bridge for stringed musical instruments |
| 30 | guitar |
| 40 | body |
| 50 | neck |
| 60 | head |
| 70 | tuning peg |
| 80 | string |
| 90 | fingerboard |
| 100 | support plate |
| 110 | bridge |
| 120 | cavity |
| 130 | pickup |
| 140 | support plate securement means |
| 150 | locking nut |
| 160 | roller-type bridge |
| 170 | main body |
| 180 | component cavity |
| 190 | support pillar |
| 200 | top plate |
| 210 | top plate screw |
| 220 | string hole |
| 230 | string cavity |
| 240 | string tuning assembly |
| 250 | fine tuning assembly |
| 260 | first string seat |
| 270 | groove |
| 280 | second string seat |
| 290 | cantilever bar |
| 300 | cantilever bar main shaft |

-continued

| DESCRIPTIVE KEY | |
|---|---|
| 310 | cantilever bar cross beam |
| 320 | cantilever bar protrusion |
| 330 | second string seat pivot beam |
| 340 | cantilever bar hole |
| 350 | internal threads |
| 360 | cantilever bar pivot hole |
| 370 | cantilever bar pivot rod |
| 380 | fine tuning means |
| 390 | fine tuning means body |
| 400 | external threads |
| 410 | fine tuning means head |
| 420 | fine tuning means body |
| 430 | fine tuning means stop |
| 440 | multi-tuning assembly |
| 450 | lever arm |
| 460 | fulcrum point |
| 470 | lever arm pivot hole |
| 480 | lever arm pivot rod |
| 490 | springs |
| 500 | lever arm pivot rod stop |
| 510 | spring loaded plunger |
| 520 | lever arm adjustment means |
| 530 | lever arm adjustment means body |
| 540 | lever arm adjustments means head |
| 550 | lever arm adjustment means hole |
| 560 | lever arm adjustment means resting plate |
| 570 | roller type nut |
| 580 | lever arm protrusion |
| 590 | lever arm adjustment means protrusion |
| 600 | Allen screw locknut |
| 610 | mounting screw |
| 620 | mounting beam |
| 630 | central portion |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 11.

1. Detailed Description of the Figures

Figure 1:
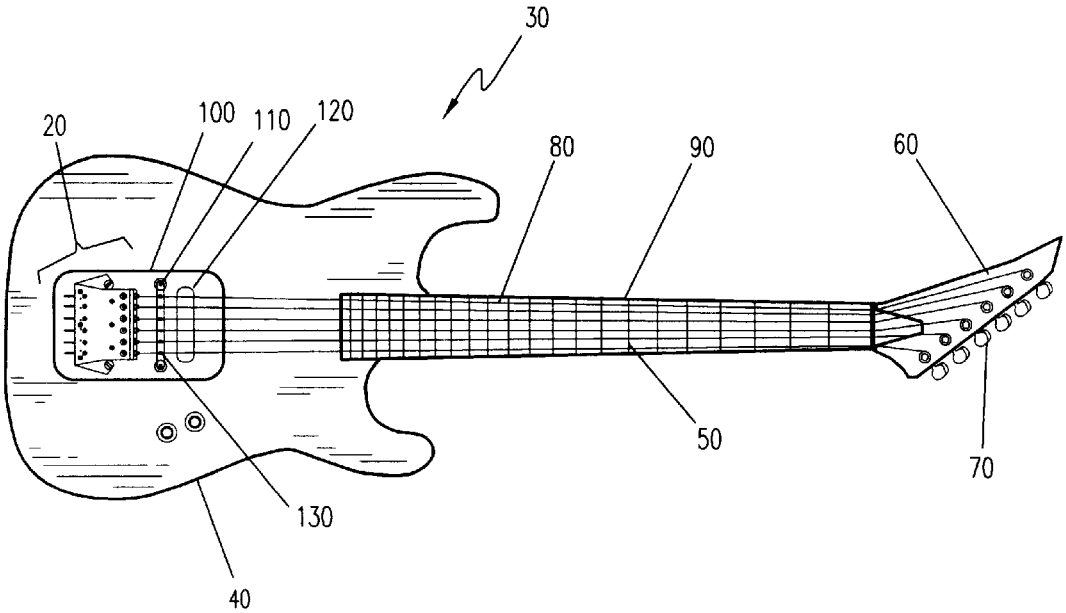
FIG. 1 is a front view of a preferred embodiment of an improved, universal, multi-position, tuning mechanism and bridge for stringed musical instruments 20 connected to an electric guitar.

Referring now to FIG. 1, an improved, universal, multi-position, tuning mechanism and bridge for stringed musical instruments 20 is shown, designed to be used with stringed instruments. In FIG. 1, an exemplary guitar 30 is shown. The guitar 30 is of the electric guitar 30 configuration, having a solid body 40, a neck 50 extending from the body 40, and a head 60 disposed at the end of the neck 50. The head 60 has a plurality of tuning pegs 70 which can selectively increase of decrease the tension placed on the strings 80. As is commonly known in the previous art, an end of the string 80 winds around the tuning peg 70 and the string 80 is pulled tight across the neck 50 and body 40 by continued rotation of the tuning peg 70. On the front surface of the neck 50, a fingerboard 90 is attached, which has individual frets, or finger positions (not shown). The musician presses the strings 80 against the fingerboard to sound individual notes.

Figure 2:
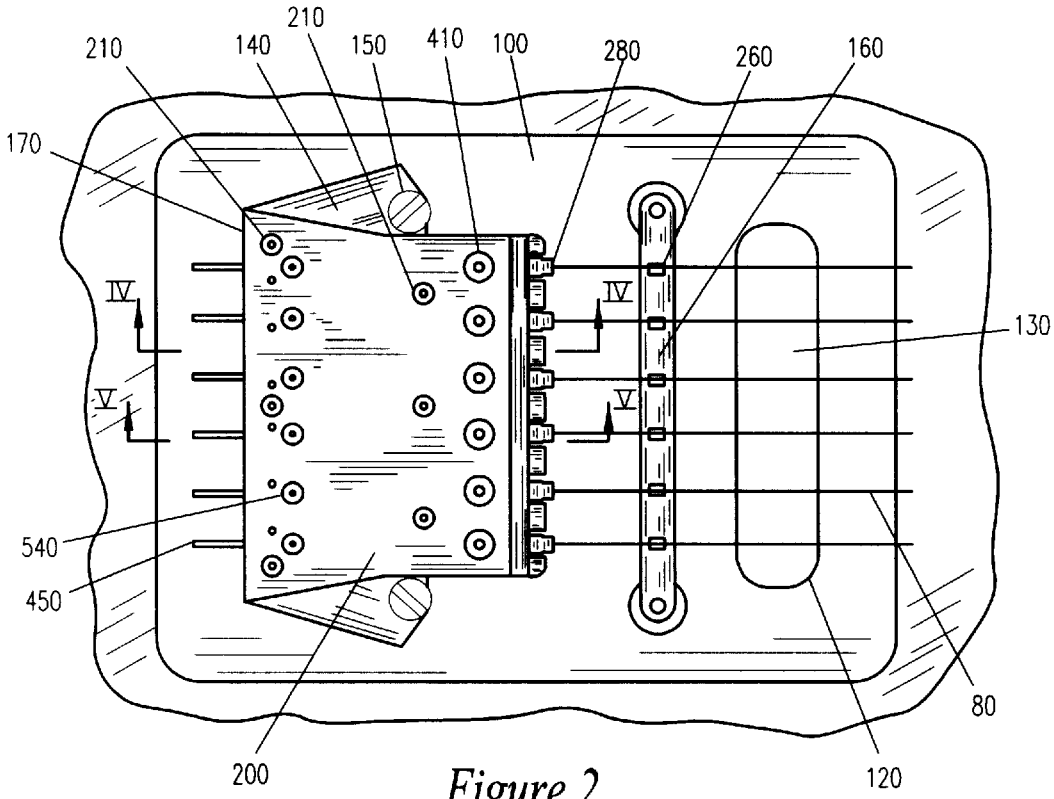
FIG. 2 is a top view of the preferred embodiment.

Referring now to FIGS. 1 & 2, the preferred embodiment of the present invention consists of a support plate 100, of a generally rectangular configuration, generally centered on the front surface of the body of the guitar 30, along the elongated centerline of the stringed instrument, toward the back of the stringed instrument, behind the location where a traditional stringed instrument bridge 110 would be located. The support plate 100 has an associated cavity 120 which is sized to enable traditional guitar 30 pickups 130 to fully extend through it.

Located on either end of the support plate 100, in vertical linear alignment when installed and in use, is a plurality of support plate securement means 140. The support plate securement means 140 are horizontally elongated, planar protrusions of a generally rectangular configuration, extending outward from the sides of the support plate 100, with the bottom surface of said support plate securement means 140 being in the same plane as the bottom surface of the support plate 100. Semicircular indentations, of a cross sectional diameter greater than a traditional stud post used on guitars 30, is used to secure the support plate 100 to the guitar 30 face via locking nuts 150.

It is envisioned that a roller-type bridge 160 is mounted to the front surface of the support plate 100, thus comprising a one-piece unit for purposes of attaching and detaching said support plate 100 from the front surface of the stringed instrument. It is envisioned that locking nuts 150, of an otherwise traditional configuration, are used with the present invention. Further, the present invention is designed to fit most Gibson™ guitars 30 without alterations being made to the guitar 30.

A main body 170, of a generally rectangular configuration, is located on top of the support plate 100, behind the roller-type bridge 160, farther from the head of the guitar 30, when the support plate 100 is mounted on a guitar 30 body 40.

Figure 3:
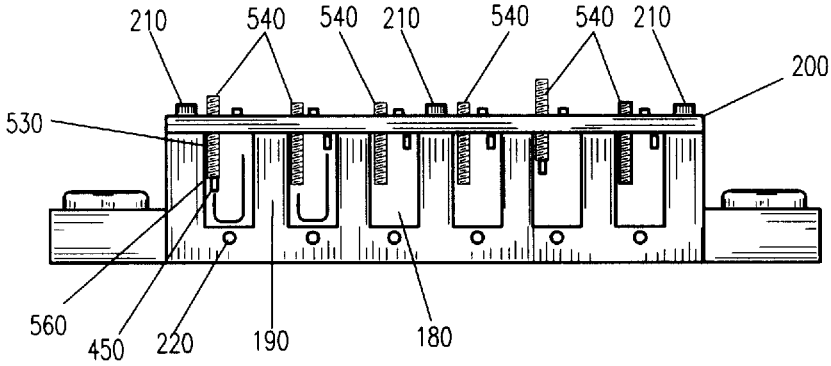
FIG. 3 is a rear view thereof.
Figure 4A:
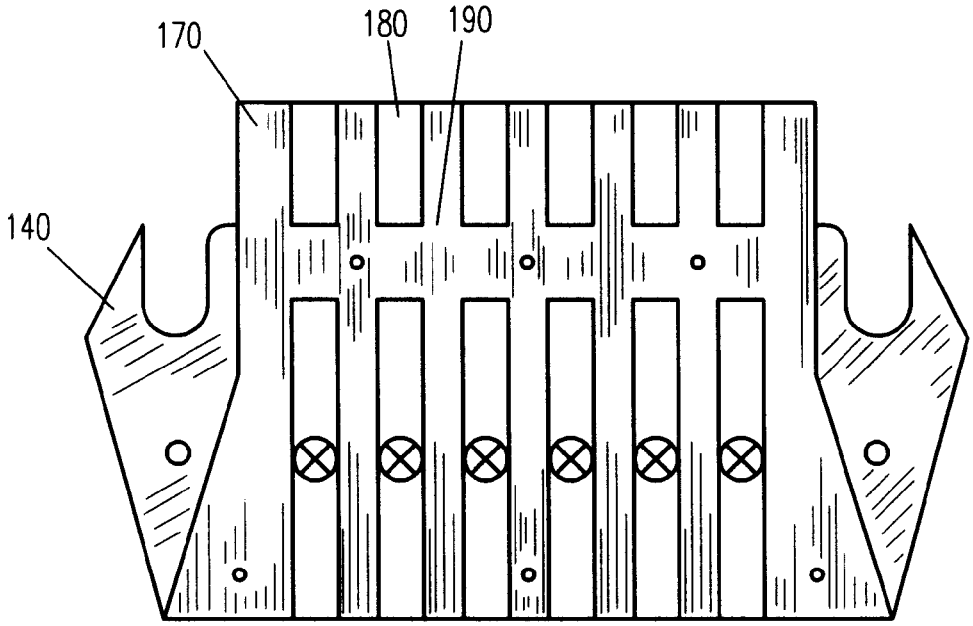
FIG. 4*a* is a top view thereof with the top plate removed.
Figure 4B:
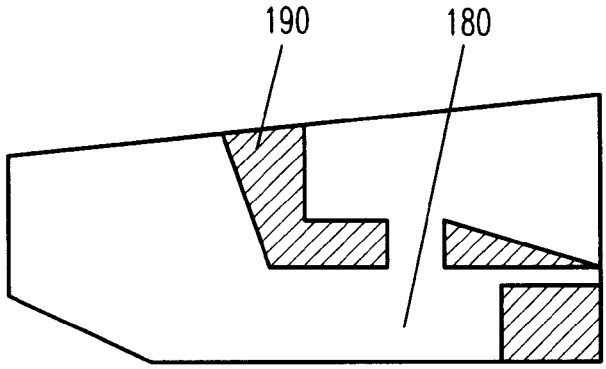
FIG. 4*b* is a cross sectional view of the main body cut along lines IV—IV.

Referring to FIGS. 3, 4*a* & 4*b,* a series of equally spaced, identical component cavities 180 is formed in the main body 170, each component cavity 180 extending downward from the top of the main body 170, toward the support plate 100. The number of component cavities 180 equals the number of strings 80 used on a given guitar 30. The configuration of each component cavity 180 is designed to hold the internal mechanical components of the present invention without leaving unnecessary space inside the main body 170.

A series of support pillars 190 is located inside the main body 170, and form the walls of the component cavities 180. Each support pillar 190 extends the height of the main body 170. A top plate 200, of a generally rectangular configuration, releasably secures to the main body 170 via connection to the support pillars 190, so as to form a closed area with the top plate 200 being the top surface and the main body 170 forming the remainder of the closed area. Securement of the top plate 200 is accomplished via top plate screws 210.

Figure 5:
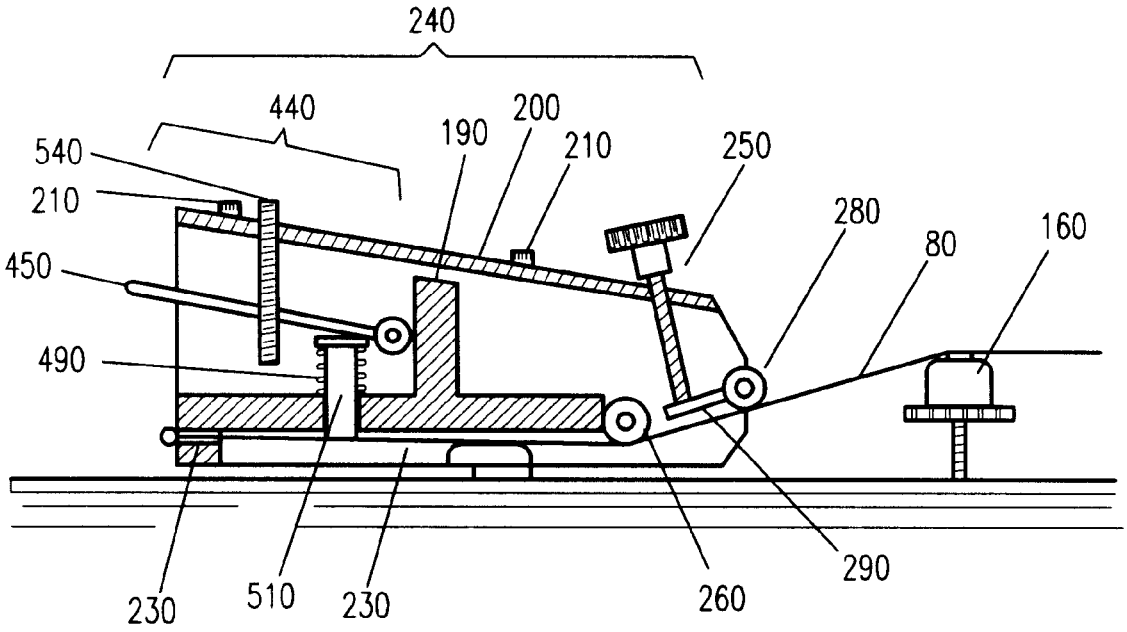
FIG. 5 is a cross sectional view of the main body with internal components connected therein, cut along lines V—V.

Referring now to FIG. 5, a plurality of string holes 220, equal to the number of strings 80 on the guitar 30, is located along the side of the main body 170, opposite the roller-type bridge 160. The string holes 220 are in linear alignment, parallel to the centerline of the roller-type bridge 160. Each string hole 220 is the opening to a string cavity 230 that extends inside of the main body 170, thus providing access for the string 80 to the interior area of the main body 170. Each string hole 220 and string cavity 230 is of a sufficient cross sectional diameter to allow the string 80 to pass through yet, small enough to embrace the stop piece on the end of the string 80.

Multiple setting tuning capabilities are provided by a plurality of string tuning assemblies 240, located inside of the main body 170. The number of string tuning assemblies 240 is equal to the number of strings 80 used in a particular guitar 30. The string tuning assemblies 240 are located inside the component cavities 180 of the main body 170. Each string 80 passes through and is adjusted by a separate string tuning assembly 240.

Figure 7A:
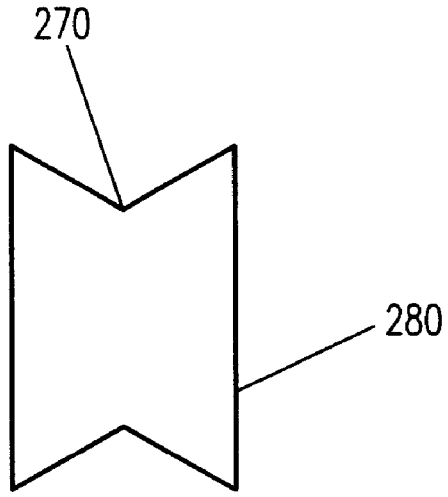
FIG. 7*a* is a front view of the first string seat.

Referring now to FIG. 7*a*, each string tuning assembly 240 is further comprised of a fine tuning assembly 250. A first string seat 260 is of a roller type configuration, with a groove 270 located in the middle of the external circumferential surface. The first string seat 260 is connected to the interior, bottom surface of the component cavity 180, near the side closer to the roller-type bridge 160. The first string seat 260 rotates in the vertical plane along the elongated centerline of the body 40 of a guitar 30, in an arc of 360 degrees, so as to facilitate the smooth movement of the guitar 30 string 80 within the main body 170.

Figure 7B:
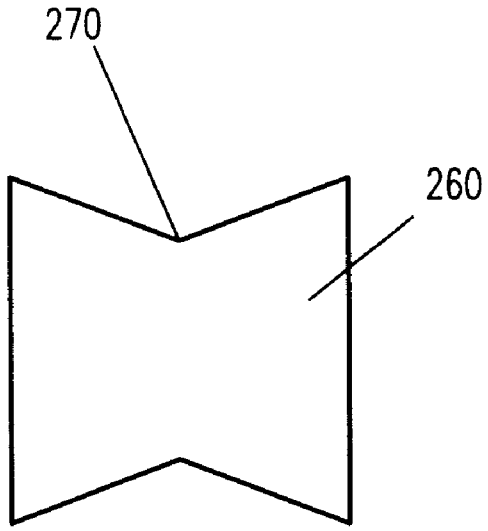
FIG. 7*b* is a front view of the second string seat.

Referring now to FIG. 7*b,* a second string seat 280 is also of a roller type configuration, with a groove 270 located in the middle of the external circumferential surface. The second string seat 280 rotates in the vertical plane along the elongated centerline of the body 40 of a guitar 30, so as to facilitate the smooth movement of the guitar 30 string 80 along its exterior surface. The second string seat 280 is located near the side of the main body 170 near the roller-type bridge 160.

Figure 8B:
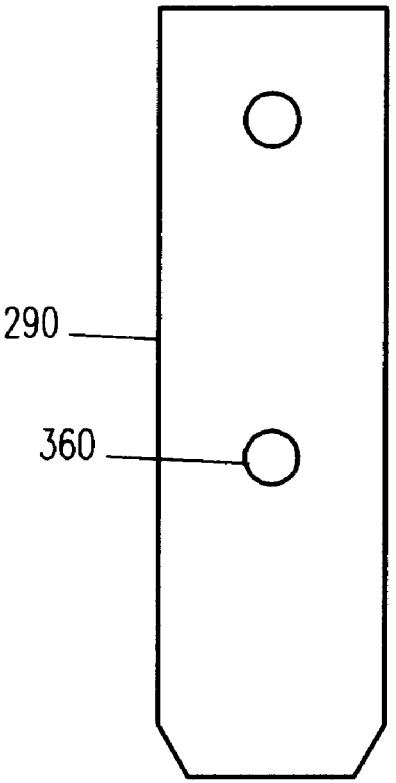
FIG. 8*b* is a side view of the cantilever bar.
Figure 8A:
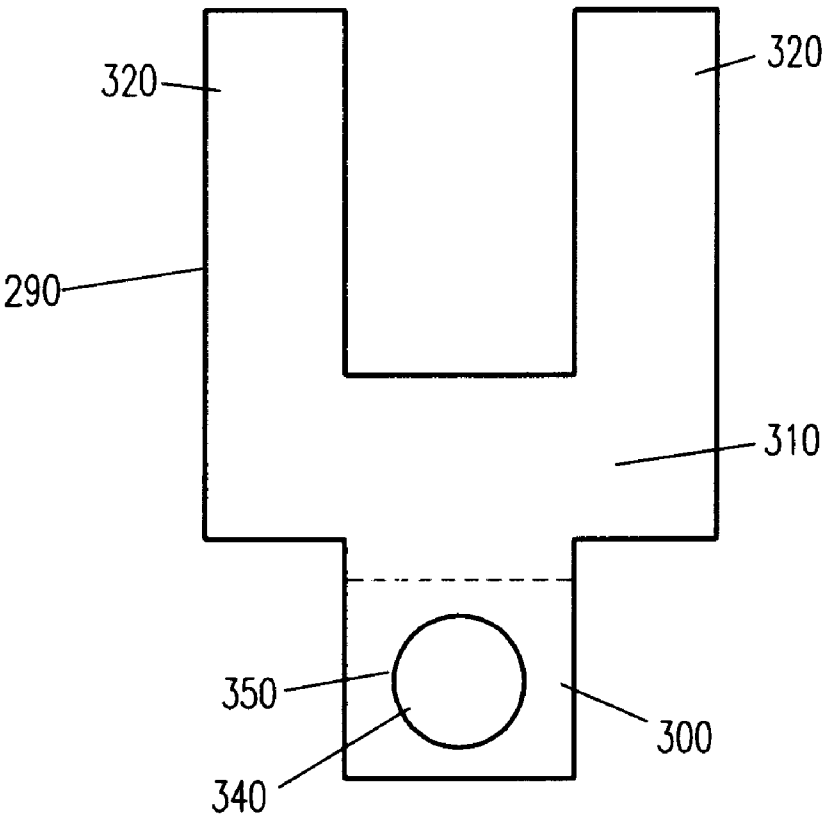
FIG. 8*a* is a top view of the cantilever bar.
Figure 9A:
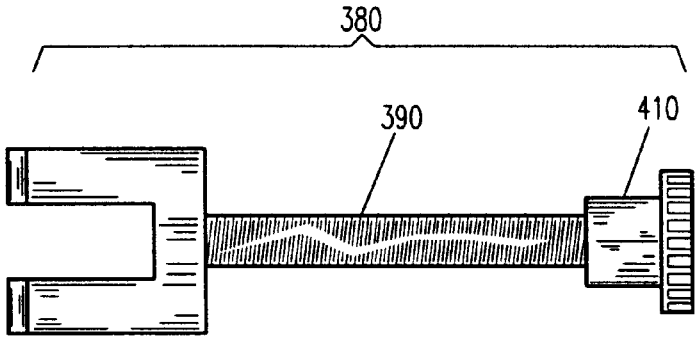
FIG. 9*a* is a top view of the fine tuning means.
Figure 9B:
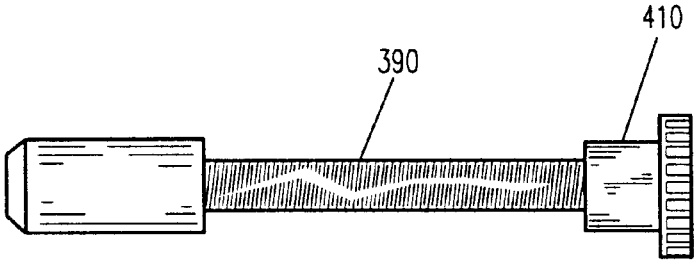
FIG. 9*b* is a side view thereof.
Figure 9C:
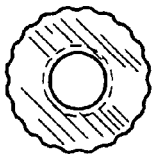
FIG. 9*c* is a top view of the fine tuning means head.

Referring now to FIGS. 5, 8*a* & 8*b*, the second string seat 280 is attached to the end of a cantilever bar 290. The cantilever bar 290 is of a generally block shaped Y-type configuration, much like a goal post, with a linearly elongated, rectangular shaped cantilever bar main shaft 300. The midpoint of a linearly elongated cantilever bar cross beam 310 intersects the end of the cantilever bar main shaft 300, perpendicular to the elongated centerline of the cantilever bar main shaft 300. Two cantilever bar protrusions 320 extend outward from the ends of the cantilever bar cross beam 310, perpendicular to the elongated centerline of the cantilever bar cross beam 310, and away from the cantilever bar main shaft 300. All components are in the same plane. A second string seat pivot beam 330 passes through the second string seat 280 and connects to the interior surface area of the ends of the two cantilever bar protrusions 320, opposite the cantilever cross beam, using connection means known in the industry, so as to permit the second string seat 280 to rotate along an arc of 360 degrees. The end of the cantilever bar 290, opposite the second string seat 280, has a cantilever bar hole 340 with internal threads 350.

Figure 6:
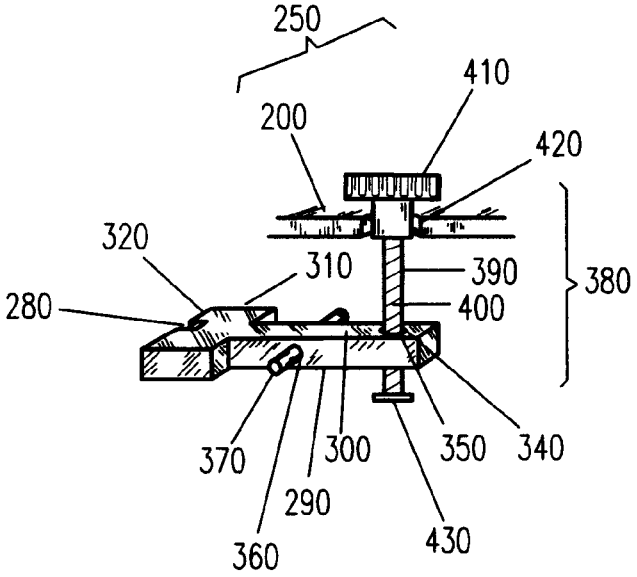
FIG. 6 is an enlarged view of the fine tuning means assembly.

Referring now to FIGS. 5 and 6, a cantilever bar pivot hole 360 is located in the center of the cantilever bar 290, through which a cantilever bar pivot rod 370 passes. The cantilever bar pivot rod 370 is positioned perpendicular to the radial centerline of the cantilever bar main shaft 300, and the cantilever bar pivot rod 370 attaches to the sides of the component cavity 180, so as to permit the cantilever bar main shaft 300 to pivot in the vertical plane.

Referring now to FIGS. 5, 6, & 9*a*–9*d*, attached to the end of the cantilever bar main shaft 300, opposite the second string seat 280, is a fine tuning means 380. The fine tuning means 380 consists of a fine tuning means body 390, of an elongated cylindrical configuration, with external threads 400.

The fine tuning means body 390 extends downward from the top plate 200 to the end of the cantilever bar main shaft 300 and into the cantilever bar hole 340. The external threads 400 on the fine tuning means body 390 mate with the internal threads 350 of the cantilever bar hole 340.

A fine tuning means head 410 is connected to the end of the fine tuning means body 390, opposite the cantilever bar main shaft 300, and extends outward from the top plate 200, through a fine tuning means hole 420 located in the top plate 200.

Referring now to FIG. 2, the plurality of fine tuning means heads 410 is located on the exterior surface of the top plate 200, equally spaced, in linear alignment with each other, and parallel to the centerline of the roller-type bridge 160, thus facilitating ease of adjustment.

The fine tuning means head 410 is used to adjust string 80 tension by being rotated. Together, the fine tuning means 380 and the cantilever bar 290 act as a cantilever mechanism in the vertical plane, and are configured such that turning the fine tuning means head 410 either clockwise or counter-clockwise either lowers or raises the second string seat 280 in the vertical plane, relative to the top surface of the support plate 100. In this manner, the tension on each string 80, and corresponding pitch created by the string 80 at that particular tension setting, can be precisely adjusted manually.

Referring now to FIG. 5, throughout its range of motion, the second string seat 280 remains in a position closer to the support plate 100 than the top of the roller-type bridge 160. Thus the string 80 is held firmly in the first string seat 260 and second string seat 280 due to the tension on the string 80 and the incline at which the string 80 travels up to the roller-type bridge 160.

Referring now to FIG. 6, a fine tuning means stop 430 is located on the end of the fine tuning means body 390, opposite the fine tuning means head 410, below the cantilever bar 290, and is designed to create mechanical interference with the cantilever bar 290 to keep the fine tuning means body 390 from disengaging from the cantilever bar hole 340.

Figure 10A:
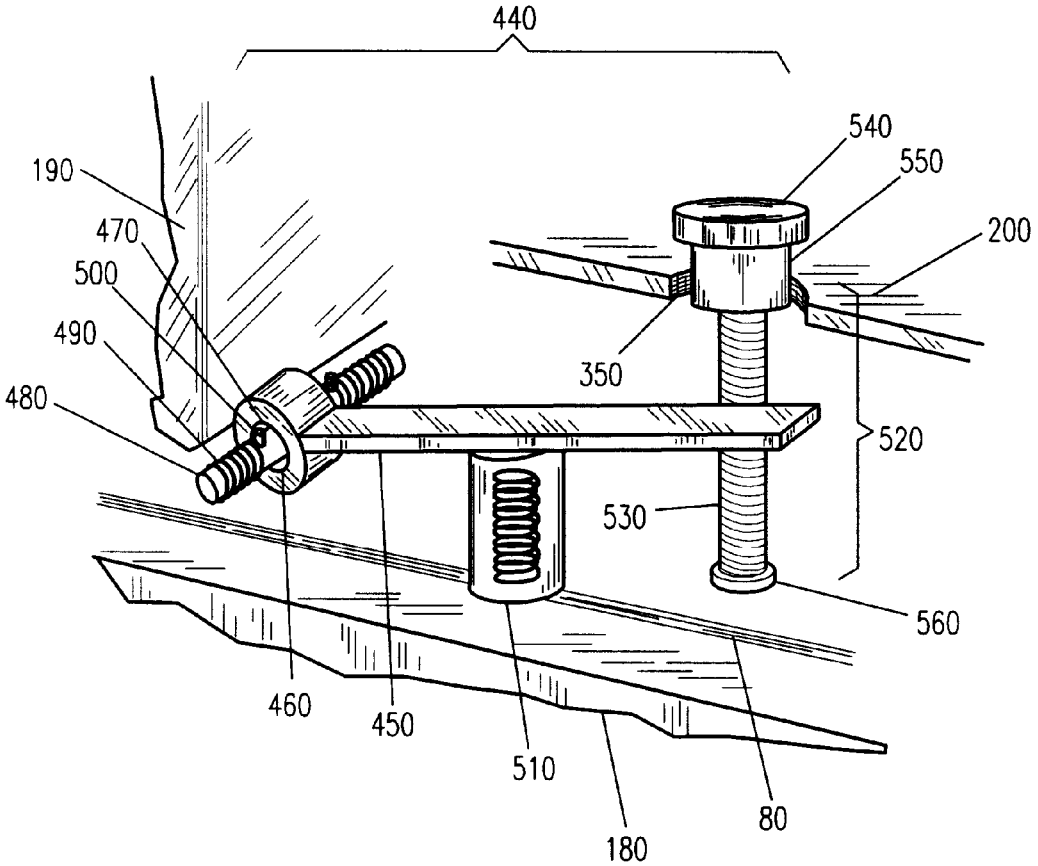
FIG. 10*a* is an exploded side view of the multi-tuning assembly in the standard position.

Referring now to FIGS. 5 & 6 & 10*a*, behind each cantilever mechanism, farther from the roller-type bridge 160, inside each component cavity 180, each string tuning assembly 240 further comprises a multi-tuning assembly 440. Each multi-tuning assembly 440 is designed to permit the operator to select from two predetermined string 80 tension settings for each string 80.

Referring now to FIG. 10, a linearly elongated, cylindrical lever arm 450 adjusts the tension of each string 80 between one of two predetermined tension levels.

The lever arm 450 terminates in a fulcrum point 460, located nearer the fine tuning means 380 and second string seat 280. A lever arm pivot hole 470 is positioned at the fulcrum point 460 at the end of the lever arm 450, and is designed to allow vertical pivoting of the lever arm 450.

A lever arm pivot rod 480 passes through the lever arm pivot hole 470, perpendicular to the radial centerline of the lever arm 450, and connects to the sides of the component cavity 180, so as to permit the lever arm 450 to pivot in the vertical plane. Springs 490 are located on the lever arm pivot rod 480, on either side of the lever arm 450 hole. Two lever arm pivot rod stops 500 keep the springs 490 in place, preventing their movement along the lever arm pivot rod 480. The springs 490 are designed to permit limited lateral movement of the lever arm 450 along the radial centerline of the lever arm pivot rod 480.

The end of the lever arm 450, opposite the lever arm pivot hole 470, extends outward, outside of the side of the main body 170 that is opposite the roller-type bridge 160.

Referring now to FIGS. 2 & 10, each lever arm 450 extends outward from the side of the main body 170 opposite the roller-type bridge 160, parallel to the elongated centerline of the guitar 30. The lever arms 450 are equally spaced, in linear alignment with each other, and are parallel to the centerline of the roller-type bridge 160.

Figure 11:
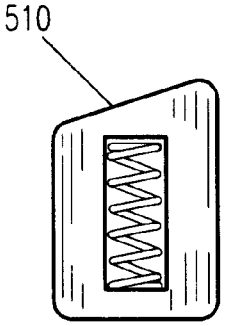
FIG. 11 is a side view of the spring loaded plunger.

Referring now to FIGS. 10*a* & 11, located between the lever arm 450 and guitar 30 string 80 is a spring loaded plunger 510. The spring loaded plunger 510 is spring biased in a direction away from the guitar 30 body 40. Each spring loaded plunger 510 moves in the vertical plane, held in vertical position by the lever arm 450 and the sides of the component cavity 180. In the resting position, the spring loaded plunger 510 forces the lever arm 450 to rest against the lower surface of the top plate 200.

The bottom of the component cavity 180 is sufficiently hollow to permit the spring loaded plunger 510 to engage the string 80 and depress the string 80 toward the support plate 100 without experiencing mechanical interference with the bottom of the component cavity 180.

Figure 10B:
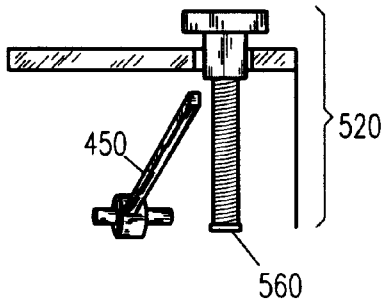
FIG. 10*b* is a back view thereof.

Referring now to FIGS. 10*a* & 10*b*, a lever arm adjustment means 520 is laterally offset from the radial centerline of the lever arm 450, and near the lateral wall of the component cavity 180. A lever arm adjustment means body 530 extends downward from the exterior surface of the top plate 200, terminating inside the main body 170. The lever arm adjustment means body has external threads 400. The lever arm adjustment means head 540 is connected to the end of the lever arm adjustment means body 530, and extends outward from a lever arm adjustment means hole 540 in the top plate 200. The lever arm adjustment means hole 540 has internal threads 350 that mate with the external threads of the lever arm adjustment means body 530, and is of slightly larger cross sectional diameter than that of the lever arm adjustment means body 530. The lever arm adjustment means head 540 can be rotated to adjust the relative vertical height of the lever arm adjustment means 520 from the spring loaded plunger 510. At the end of the lever arm adjustment means body 530, opposite the lever arm adjustment means head 540, is a lever arm adjustment means resting plate 560, of a flat configuration, designed to permit a string 80 to rest against it.

The lever arm 450 is capable of resting in one of two positions, one for each of the different tones to which the string 80 is preadjusted. Referring now to FIGS. 10*a* & 10*b*, the first, or normal position, is intended for normal playing tone, and corresponds to the lever arm 450 resting against the lower surface of the top plate 200.

Figure 10C:
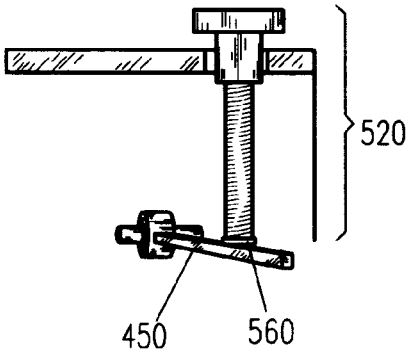
FIG. 10*c* is an exploded side view of the multi-tuning assembly in the non-traditional position.
Figure 10D:
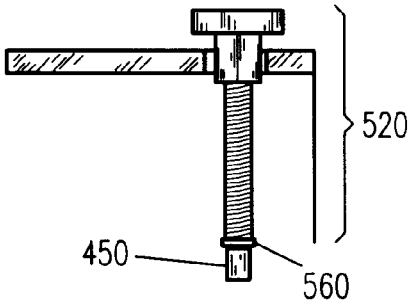
FIG. 10*d* is a back view thereof.

Referring now to FIGS. 10*c* & 10*d*, the second position is intended for nontraditional tones, and is achieved by lowering the lever arm 450, moving it laterally under the lever arm adjustment means 520, and allowing the lever arm 450 to rest beneath the lever arm adjustment means resting plate 560. The lever arm adjustment means 560 permits precise adjustment of the tension in the second, or non-traditional setting, with the lever arm 450 beneath the lever arm adjustment means resting plate 560. Adjustment is made via twisting the lever arm adjustment means head 540 either clockwise or counterclockwise. By adjusting the lever arm 450, a variable amount of force is placed upon the string 80, manipulating string 80 tension and producing a variable pitch.

Referring now to FIG. 2, the lever adjustment means heads are located on the exterior surface of the top plate 200, equally spaced, in linear alignment with each other, and parallel to the centerline of the roller-type bridge 160, thus facilitating ease of adjustment of the multi-tuning lever settings.

Referring now to FIG. 10*a*, the present invention is configured such that a guitar 30 string 80 passes through the string cavity 230, into the main body 170, engaging the multi-tuning assembly 440, passing under the first string seat 260 and second string seat 280, and continuing over the roller-type bridge 160 to the tuning pegs at the head of the guitar 30. The string 80 is held firmly in the string seats due to the tension and the incline at which the string 80 travels up to the roller-type bridge 160.

It is envisioned that other styles and configurations of the main body 170, support plate 100, fine tuning assemblies 250 and multi-tuning assemblies 440 can be easily incorporated into the teachings of the present invention, and only one particular configuration shall be shown and described for purposes of clarity and disclosure and not by way of limitation of scope.

It is envisioned that the main body 170, support plate 100 and component parts are constructed of a strong, lightweight material, such as plastic or metal.

Figure 12:
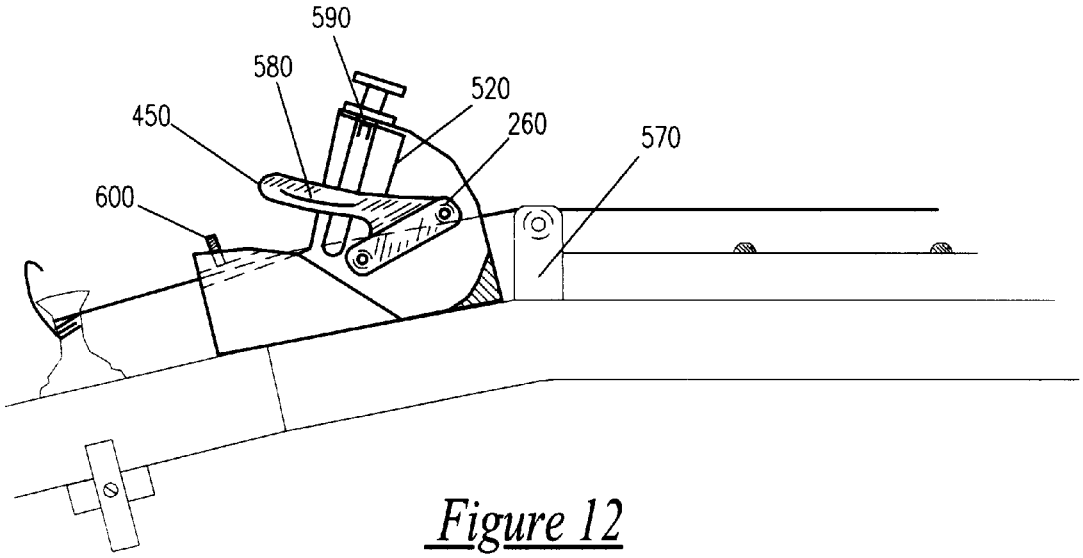
FIG. 12 is a side view of an alternate embodiment of the present invention in position on a guitar.

Referring now to FIG. 12, it is envisioned that in an alternate embodiment of the present invention, the main body 170 is mounted just behind the head 60 of the guitar 30, and is used in conjunction with a roller type nut 570, positioned on the guitar 30 neck 50, just behind the main body 170.

Figure 13:
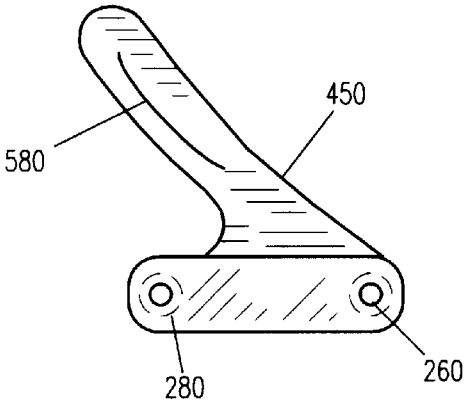
FIG. 13 is a side view of a lever arm.

Referring now to FIGS. 12 & 13, the lever arm 450 is of a generally L-shaped configuration, with a first string seat 260 and a second string seat 280 positioned next to each other, on the lower portion of the same side of the lever arm 450. The string seats are positioned such that a string 80 can be positioned with the first string seat 260 located above the string 80 and the second string seat 280 located below the string 80.

The lever arm 450 pivots vertically. As the lever arm 450 pivots, either the first string seat 260 or the second string seat 280 comes into mechanical interference with the string 80, thereby adjusting the tension on the string 80 and resultant musical pitch.

A lever arm protrusion 580 is located on one side of the lever arm 450, and extends outward laterally from the lever arm 450.

The lever arm adjustment means 520 is of an "alligator clip" configuration, with a lever arm adjustment means protrusion 590 extending outward laterally from the lever arm adjustment means body 530.

The lever arm protrusion 580 is designed to be capable of being raised above and subsequently coming into mechanical interference with the upper surface of the lever arm adjustment means protrusion 590, thereby providing an adjustment setting for the string 80.

An Allen screw locknut 600 is located at the anterior of the main body 170, above the string cavity 230, and is designed to provide adjustment to the string 80.

Figure 14:
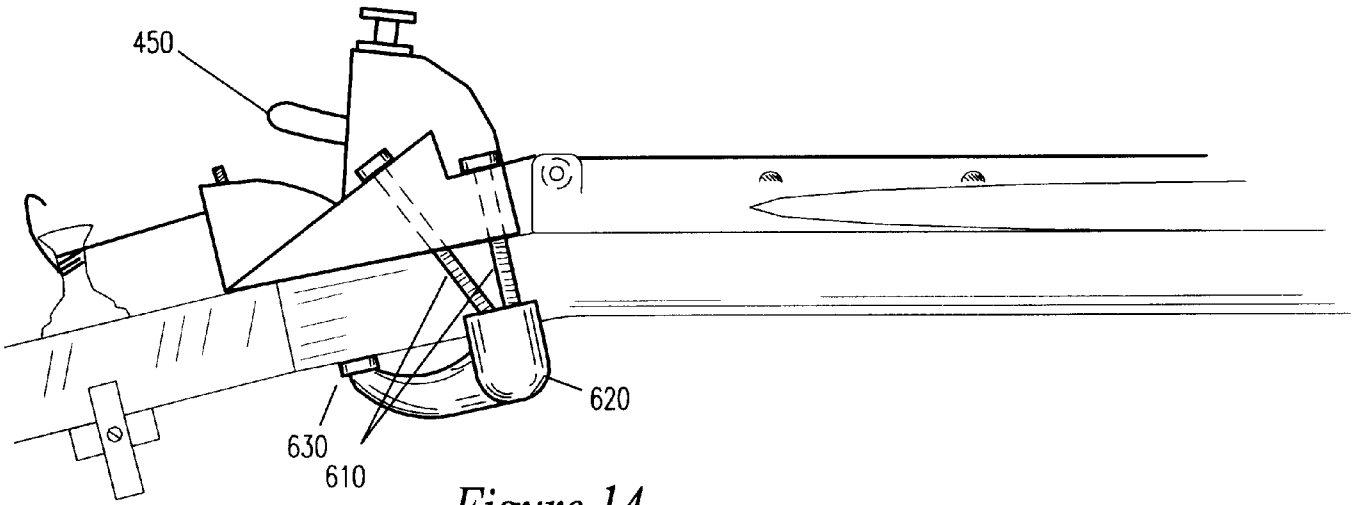
FIG. 14 is a side view of the alternate embodiment of the present invention in position on a guitar via a mounting beam.

Referring now to FIG. 14, a plurality of mounting screws 610, located on each lateral side of the main body 170, penetrate through the main body 170, through the neck 50 of the guitar 30, connecting to a mounting beam 620, of generally curved, cylindrical, U-shaped construction.

Figure 15B:
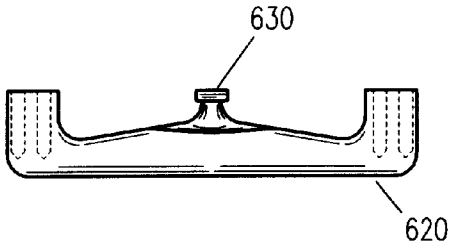
FIGS. 15*a* & 15*b,* are a top view and rear view, respectively, of a mounting beam.
Figure 15A:
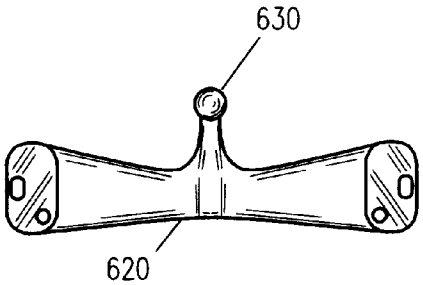

Referring now to FIGS. 15*a* & 15*b*, the laterally protruding, central portion 630 of the mounting beam 620 is designed to come into mechanical interference with the underside of the head 60 of the guitar 30, providing frictional securement as well as facilitating quick installation and removal of the main body 170.

2. Operation of the Preferred Embodiment

To use the present invention: first, remove the old strings 80 and the stop tailpiece (not shown) of a traditional guitar 30; second, clean the guitar 30 thoroughly; third, install locking nuts 150; fourth, replace the stop tailpipe with the support plate 100, on which the roller-type bridge 160 and main body 170 are contained; fifth, pass strings 80, one at a time, through their respective string hole 220, making sure the string 80 is properly set in the first string seat 260 and the second string seat 280; sixth, pass the strings 80 through the respective locking nuts 150 and tuning pegs; seventh, tune the string 80 to the desired tension; eighth, set the fine tuning means 380 to the mid-adjustment capabilities; ninth, with the lever arm 450 in the first or traditional position, resting against the lower surface of the top plate 200, adjust the fine tuning means 380 to the desired traditional tone; tenth, position the lever arm 450 in the second, or non-traditional position, beneath the lever arm adjustment means resting plate 560; eleventh, adjust the lever arm adjustment means 520 to create the desired non-traditional tone; twelfth, tighten down the locking nuts 150; thirteenth, play the guitar 30 as desired.

The foregoing description is included to illustrate the operation of the preferred embodiment and is not meant to limit the scope of the invention. The scope of the invention is to be limited only by the following claims.

What is claimed is:

1. A tuning mechanism and bridge for stringed musical instruments comprising:

a support plate, of a rectangular configuration, generally centered on the front surface of said body of said stringed musical instrument;

a cavity located on said support plate, said cavity formed from and part of said support plate;

two support plate securement means, located on either end of said support plate, said support plate securement means being designed to be used with locking to releasably secure said support plate to a face of said stringed musical instrument;

a roller-type bridge, mounted to the front surface of said support plate;

a main body, of a rectangular configuration, located on top of said support plate, behind said roller-type bridge;

a top plate, of a generally rectangular configuration, releasably secured to the top of said main body so as to form an enclosed volume with said top plate defining the uppermost boundary of said enclosed volume and said main body forming the remainder boundary of said enclosed volume;

top plate screws, said top plate screws used to secure said top plate to the top of said main body.

2. The tuning mechanism and bridged described in claim 1, wherein said main body further comprises:

a series of equally spaced, identical component cavities formed from said main body, one said component cavity for each string of said stringed instrument, each said component cavity extending downward from the top of said main body, toward said support plate;

a series of support pillars located inside said main body, and forming the walls of said component cavities, with each support pillar extending the height of said main body;

a plurality of string holes, equal to the number of strings on said guitar, located along the side of said main body, opposite said roller-type bridge, said string holes being in linear alignment, parallel to the centerline of said roller-type bridge, and each string hole being the opening to a string cavity that extends inside of said main body, thus providing access for said string to the interior area of said main body; each string hole and string cavity is of a sufficient cross sectional diameter to allow said string to pass through yet small enough to embrace said stop piece on the end of said string;

a plurality of fine tuning assemblies, located inside of the component cavities of said main body, with the number of string-tuning assemblies being equal to the number of strings used in a particular stringed instrument, with each string passing through said fine tuning assembly and adjusted by a separate fine tuning assembly;

a plurality of multi-tuning assemblies, equal to the number of strings on said stringed instrument, said multi-tuning assemblies located behind each fine tuning assembly, farther from said roller-type bridge, and designed to permit the operator to select from two predetermined string tension settings for each string.

3. The tuning mechanism and bridge of claim 2, wherein each said fine tuning assembly further comprises:

a first string seat of a roller type configuration, with a groove located in the middle of the external circumferential surface, said first string seat connected to the interior, bottom surface of said component cavity, near the side closer to said roller-type bridge, and rotatable in the vertical plane along the elongated centerline of said body of said stringed instrument, in an arc of 360 degrees, so as to facilitate the smooth movement of said string within said main body;

a second string seat of a roller type configuration, located near the side of said main body near said roller-type bridge, with a groove located in the middle of the external circumferential surface, said second string seat rotatable in the vertical plane along the elongated centerline of the body of said stringed instrument, so as to facilitate the smooth movement of said string along its exterior surface;

a cantilever bar, having two ends, with one end attached to said second string seat, said cantilever bar being of a generally block shaped Y-type configuration, much like a goal post, said end of said cantilever bar designed to allow said second string seat to rotate about it while said cantilever bar pivots in the vertical plane;

a cantilever bar hole, located on the end of the cantilever bar, opposite the second string seat, said cantilever bar hole having internal thread;

a fine tuning means, attached to the end of said cantilever bar main shaft, opposite said second string seat, said fine tuning mean designed to permit adjustment of string tension for each individual string.

4. The tuning mechanism and bridge described of claim 3, wherein said fine tuning means further comprise:

a fine tuning means body, having two ends, said fine tuning means body being of an elongated cylindrical configuration, with external threads, said fine tuning means body extending downward from said top plate to the end of said cantilever bar main shaft and into said cantilever bar hole; said external threads on said fine tuning means body mating with said internal threads of said cantilever bar hole;

a fine tuning means head, connected to the end of said fine tuning means body, opposite said cantilever bar main shaft, said fine tuning means head extending outward from said top plate, through a fine tuning means hole located in said top plate, and used to adjust string tension by being rotated;

a fine tuning means stop located on the end of said fine tuning means body, opposite said fine tuning means head, below said cantilever bar, said fine tuning means stop designed to create mechanical interference to keep said fine tuning means body from disengaging from said cantilever bar hole.

5. The tuning mechanism and bridge described of claim 4, wherein said fine tuning means heads are located on the exterior surface of said top plate, equally spaced, thus facilitating ease of adjustment.

6. The tuning mechanism and bridge described of claim 3, wherein together, said fine tuning means and said cantilever bar act as a cantilever mechanism in the vertical plane, and are configured such that turning said fine tuning means head either clockwise or counterclockwise either lowers or raises said second string seat in the vertical plane, relative to the top surface of said support plate.

7. The tuning mechanism and bridge described in claim 2, wherein said multi-tuning assemblies further comprise:

a linearly elongated, cylindrical lever arm, having two ends, and designed to adjust the tension of each string between one of two predetermined tension levels, said lever arm terminating in a fulcrum point, located nearer said fine tuning means and second string seats, with a lever arm pivot hole positioned at said fulcrum point at the end of said lever arm, and designed to allow vertical pivoting of said lever arm;

a lever arm pivot rod, said lever arm pivot rod passing through said lever arm pivot hole, perpendicular to the radial centerline of said lever arm, and connecting to the sides of said component cavity, so as to permit said lever arm to pivot in the vertical plane;

two springs located on said lever arm pivot rod, on either side of said lever arm hole, said springs designed to permit limited lateral movement of said lever arm along the radial centerline of said lever arm pivot rod;

two lever arm pivot rod stops, designed to keep said springs in place, preventing their movement along said lever arm pivot rod;

a spring loaded plunger, located between said lever arm and guitar string is a spring loaded plunger, said spring loaded plunger being spring biased in a direction away from said guitar body; each plunger moving in the vertical plane, held in vertical position by said lever arm and the sides of said component cavity, and in the resting position, said spring loaded plunger forces said lever arm to rest against the lower surface of said top plate;

a lever arm adjustment means, laterally offset from the radial centerline of said lever arm, near the lateral wall of said component cavity, said lever arm adjustment means designed to facilitate securement and adjustment of said lever arm in the second, or nontraditional setting.

8. The tuning mechanism and bridge described in claim 7, wherein said lever arm adjustment means further comprises:

a lever arm adjustment means body, having external threads, said lever arm adjustment means body extending downward from the exterior surface of said top plate, terminating inside said main body;

a lever arm adjustment means head, connected to the end of said lever arm adjustment means body, and extends outward from a lever arm adjustment means hole in said top plate, said lever arm adjustment means head rotatable in order to adjust the relative vertical height of said lever arm adjustment means from said spring loaded plunger;

a lever arm adjustment means resting plate, of a flat configuration, located at the end of said lever arm adjustment means body, opposite said lever arm adjustment means head, said lever arm adjustment means resting plate designed to permit a string to rest against it;

a lever arm adjustment means hole, having internal threads that mate with the external threads of the lever arm adjustment means body, said lever arm adjustment means hole being of slightly larger cross sectional diameter than that of said lever arm adjustment means body.

9. The tuning mechanism and bridge described in claim 7, wherein the end of said lever arm, opposite said lever arm pivot hole, extends outward, outside of the side of said main body opposite said roller-type bridge, parallel to the elongated centerline of the guitar, said lever arms being equally spaced, so as to facilitate ease of adjustment.

10. The tuning mechanism and bridge described in claim 7, wherein said lever arm is capable of resting in one of two positions, one for each of the different tones to which the string is preadjusted:

the first position, or normal position, being intended for normal playing tone, and corresponding to said lever arm resting against the lower surface of said top plate;

the second position being intended for nontraditional tones, and is achieved by lowering said lever arm, moving it laterally under said lever arm adjustment means, and allowing said lever arm to rest beneath said lever arm adjustment means resting plate; as such, said lever adjustment means permits precise adjustment of the tension in the second, or non-traditional setting, with said lever arm beneath said lever arm adjustment means resting plate.

11. The tuning mechanism and bridge described in claim 10, wherein adjustment is made to said string in the second, or non-traditional position, via twisting said lever arm adjustment means head either clockwise or counterclockwise, thus, by adjusting said lever arm, a variable amount of force is placed upon said string, manipulating string tension and producing a variable pitch.

12. The multi-position tuning mechanism and bridge described in claim 8, wherein said lever adjustment means heads are located on the exterior surface of said top plate, equally spaced, thus facilitating ease of adjustment of said multi-tuning lever when in the second, or non-traditional setting.

13. The tuning mechanism and bridge described in claim 2, wherein said main body, fine tuning assemblies and said multi-tuning assemblies are configured such that a string passes through said string cavity, into said main body, engaging said assembly, passing under said first string seat and second string seats, and continuing over said roller-type bridge to said tuning pegs at said head of said stringed instrument, with said string held firmly in said string seats due to the tension and the incline at which said string travels up to said roller-type bridge.

* * * * *